US007299941B2

(12) United States Patent
McMahon, III et al.

(10) Patent No.: US 7,299,941 B2
(45) Date of Patent: Nov. 27, 2007

(54) CONTAINER SEAL WITH FLEXIBLE CENTRAL PANEL

(75) Inventors: Thomas Joseph McMahon, III, Celebration, FL (US); Dimitri M. C. J. Backaert, Moorsel (BE); Brent E. D'Alessio, Palm Bay, FL (US); David Daud Kusuma, Orlando, FL (US); Johan M. J. K. Mortier, Grimminge (BE); John E. Sumter, Sanford, FL (US); Raymond Joseph Trudeau, Saint Cloud, FL (US)

(73) Assignee: Dart Industries Inc., Orlando, FL (US)

( * ) Notice: Subject to any disclaimer, the term of this patent is extended or adjusted under 35 U.S.C. 154(b) by 0 days.

(21) Appl. No.: 10/413,821

(22) Filed: Apr. 15, 2003

(65) Prior Publication Data

US 2004/0206765 A1 Oct. 21, 2004

(51) Int. Cl.
*B65D 41/16* (2006.01)
*B65D 51/00* (2006.01)

(52) U.S. Cl. ..... 220/780; 220/287; 220/796; 215/319

(58) Field of Classification Search ..... 229/125.07, 229/125.13; 220/319, 305, 796, 780, 281, 220/287; 215/274, 319
See application file for complete search history.

(56) References Cited

U.S. PATENT DOCUMENTS 1,215,724 A * 2/1917 Shaffer ..... 220/305
2,034,739 A 3/1936 Bodor
2,682,970 A * 7/1954 Brothers, Jr. ..... 220/361
2,894,844 A * 7/1959 Shakman ..... 426/118
2,971,671 A * 2/1961 Shakman ..... 220/624
3,080,993 A * 3/1963 Livingstone ..... 220/305
3,142,409 A * 7/1964 Ross ..... 220/281
3,163,314 A * 12/1964 Mauser ..... 220/305
3,658,217 A * 4/1972 Collie et al. ..... 222/463
3,679,088 A 7/1972 Swett et al.
3,692,208 A 9/1972 Croyle et al.
3,956,550 A * 5/1976 Sutch ..... 428/81
4,187,953 A 2/1980 Turner
4,238,047 A * 12/1980 Helms et al. ..... 220/782
4,305,535 A 12/1981 Brundige et al.
4,378,895 A 4/1983 Woinarski (Continued)

FOREIGN PATENT DOCUMENTS

AT 296141 1/1972

(Continued)

OTHER PUBLICATIONS

EMSA VIVARIO Oval baking dish multipurpose cover—(photocopy of packaging and stretchable cover as seen from underside) Date not known.

*Primary Examiner*—Robin A. Hylton

(57) ABSTRACT

A seal mountable to the rim of an open mouth container the seal including a resiliently flexible central panel separately formed from and intimately bonded to a substantially rigid peripheral mounting ring adapted to snap-mount to the rim of the container with the central panel being selectively flexible both inward and outward relative to the interior of the container for the accommodation of both overfilled and underfilled conditions through a variation in the head space beneath the mounted seal.

28 Claims, 9 Drawing Sheets

U.S. PATENT DOCUMENTS

| | | | | |
|---|---|---|---|---|
| 4,471,880 | A | | 9/1984 | Taylor et al. |
| 4,793,510 | A | | 12/1988 | Arfert et al. |
| RE32,927 | E | | 5/1989 | Taylor et al. |
| 5,147,059 | A | | 9/1992 | Olsen et al. |
| 5,409,126 | A | | 4/1995 | DeMars |
| 5,597,096 | A | * | 1/1997 | Jeppesen et al. ..... 222/498 |
| D383,989 | S | | 9/1997 | Arnoux et al. |
| 5,855,288 | A | | 1/1999 | Dallas, Jr. |
| 5,911,334 | A | | 6/1999 | Helms |
| 5,921,432 | A | | 7/1999 | Van Berne et al. |
| 5,944,211 | A | | 8/1999 | Woodnorth et al. |
| D415,652 | S | | 10/1999 | Loew et al. |
| 6,260,729 | B1 | * | 7/2001 | Mitchell et al. ..... 220/287 |
| D475,573 | S | | 6/2003 | Jalet et al. |

FOREIGN PATENT DOCUMENTS

| | | | |
|---|---|---|---|
| DE | 843379 | * | 7/1952 |
| JP | 58-169375 | | 6/1985 |
| JP | 08-295354 | | 11/1996 |

* cited by examiner

CONTAINER SEAL WITH FLEXIBLE CENTRAL PANEL

BACKGROUND OF THE INVENTION

The present invention is broadly concerned with containers of the type normally utilized in a kitchen environment for the storage of foodstuffs. More particularly, the invention is concerned with seals for such containers.

The conventional seals, for the most part, are adapted to snap-lock to the container rim and, depending upon the nature of the specific seal, provide particular advantages including an effective sealing capability, ease of mounting and/or removal, the capability of accommodating itself to overloaded containers, and the like.

Of interest with regard to the known prior art, is U.S. Pat. No. 6,260,729 B1, issued Jul. 17, 2001, to Mitchell et al. which discloses a one-piece highly elastic sealing cover wherein both the corrugated central panel and peripheral integral bead are elastically stretchable outwardly to both conform to different size and shape containers and laterally expand to accommodate foodstuffs projecting above the top rim of the container. A similar product is sold by a company known as EMSA which is a flaccid sheet with an integral peripheral bead, much in the manner of a bathing cap or shower cap, which can be stretched over the top of a container regardless of variations in the container configuration.

One-piece seals with central panels which flex slightly to assist in mounting the seal will be noted in U.S. Pat. No. 3,679,088, issued Jul. 25, 1972, to Swett et al and U.S. Pat. No. 3,692,208, issued Sep. 19, 1972 to Croyle et al.

SUMMARY OF THE INVENTION

In achieving a superior seal, the present invention proposes a seal which is both particularly user friendly and uniquely capable of adjustment to accommodate, through an effective variation in the head space of a container, to both overfilled and underfilled conditions. In other words, were the foodstuff within the container to project above the rim of the container, the seal, and more particularly the flexible central panel thereof, will elastomerically flex or deform upwardly to enclose the overfill. Should the container products occupy less than the full capacity of the container, the flexible central panel need merely be manually depressed inwardly into the container to reduce the head space and forcibly expel air from the head space. Upon release of the downward push on the panel, a tendency for the flexible panel to elastically return to its at rest position will be resisted by the partial vacuum or underpressure created by the expelled air. Basically, by creation of the partial vacuum, the ambient pressure or pressure outside of the container will be greater than pressure within the container. Thus, the seal central panel will remain flexed inwardly in its depressed position reducing the head space and attaining the advantages thereof including stabilization of the container contents and whatever preservation advantages might be achieved by the partial vacuum or underpressure created.

The superior seal of the invention, in addition to the flexible central panel, specifically provides a rigid or substantially rigid peripheral mounting ring to which the separately formed central panel is fixedly bonded, preferably by melt bonding.

The mounting ring is of a fixed predetermined shape-sustaining configuration and mounts to a container rim of conforming configuration and size by snap locking thereto much in the manner of a conventional container seal. The nature of the mounting ring, referred to as rigid or substantially rigid, is such as to be of a fixed configuration with a minimal degree of lateral elastic bendability to allow the snap locking to a container rim. This will also allow for what is frequently referred to as a "burping" action in mounting the seal to an underfilled container. No awkward stretching or other manipulation is required, and a user familiar with the conventional container seal will similarly encounter no difficulties in the mounting and removal of the improved seal of the invention.

The flexible central panel, whether flexing automatically to accommodate overfill or manually flexed to accommodate underfill, flexes relative to and independently of the rigid mounting ring.

As an example of materials considered appropriate for the seal, a silicone central panel can be used with a polybutylene terepthalate (PBT) ring. These materials are compatible from a molding standpoint. Other materials include a thermoplastic urethane (TPU) or thermoplastic elastomer (TPE) central panel with a polypropylene (PP) ring. Other appropriate materials incorporating the required characteristics of the seal of the invention can of course be used.

Other details, objects and advantages of the invention will become apparent from the more complete description following hereinafter.

DESCRIPTION OF PREFERRED EMBODIMENTS

Figure 1:
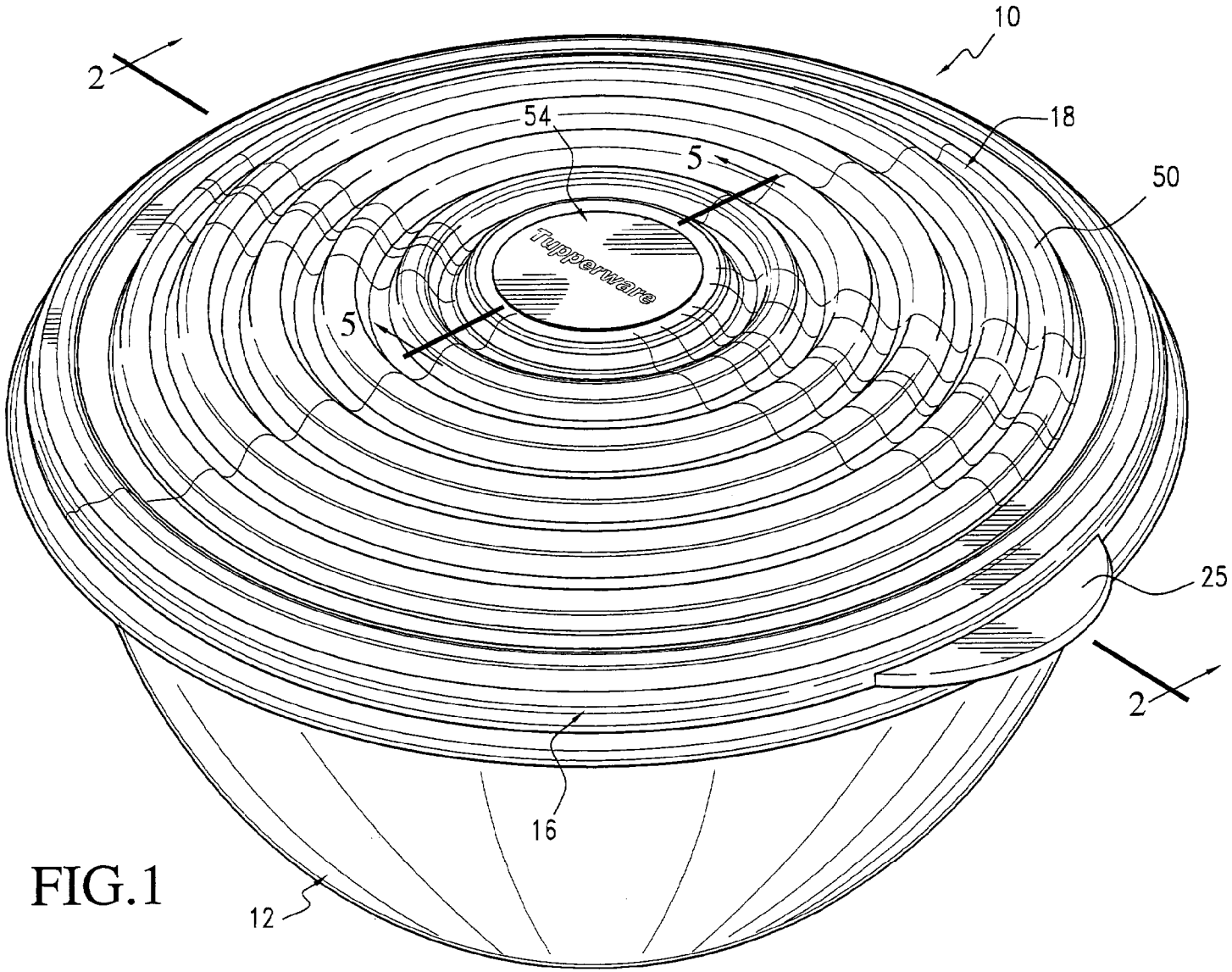
FIG. 1 is a perspective view of a container with the seal of the invention mounted thereon.

Referring now more specifically to the drawings, the seal 10, as illustrated in FIG. 1, mounts to a conventional container 12, normally formed of an appropriate rigid synthetic resinous material, with an upper rim portion 14 defining the open mouth of the container 12. The shape of the container 12, and more particularly the size and configuration of the rim 14, will define the configuration of the seal which is to snap lock thereto in a manner to be described subsequently.

The seal 10 is basically formed of two components, a substantially rigid peripheral mounting ring 16 and a flexible elastomeric central panel 18. While the term "ring" is used to refer to the substantially rigid edge or peripheral lip component 16 of the seal 10, it is to be appreciated that this "ring" is not limited to an annular configuration, but rather, depending upon the configuration of the rim 14 of the container, can be of any other appropriate shape including oval, rectangular, and the like.

Figure 4:
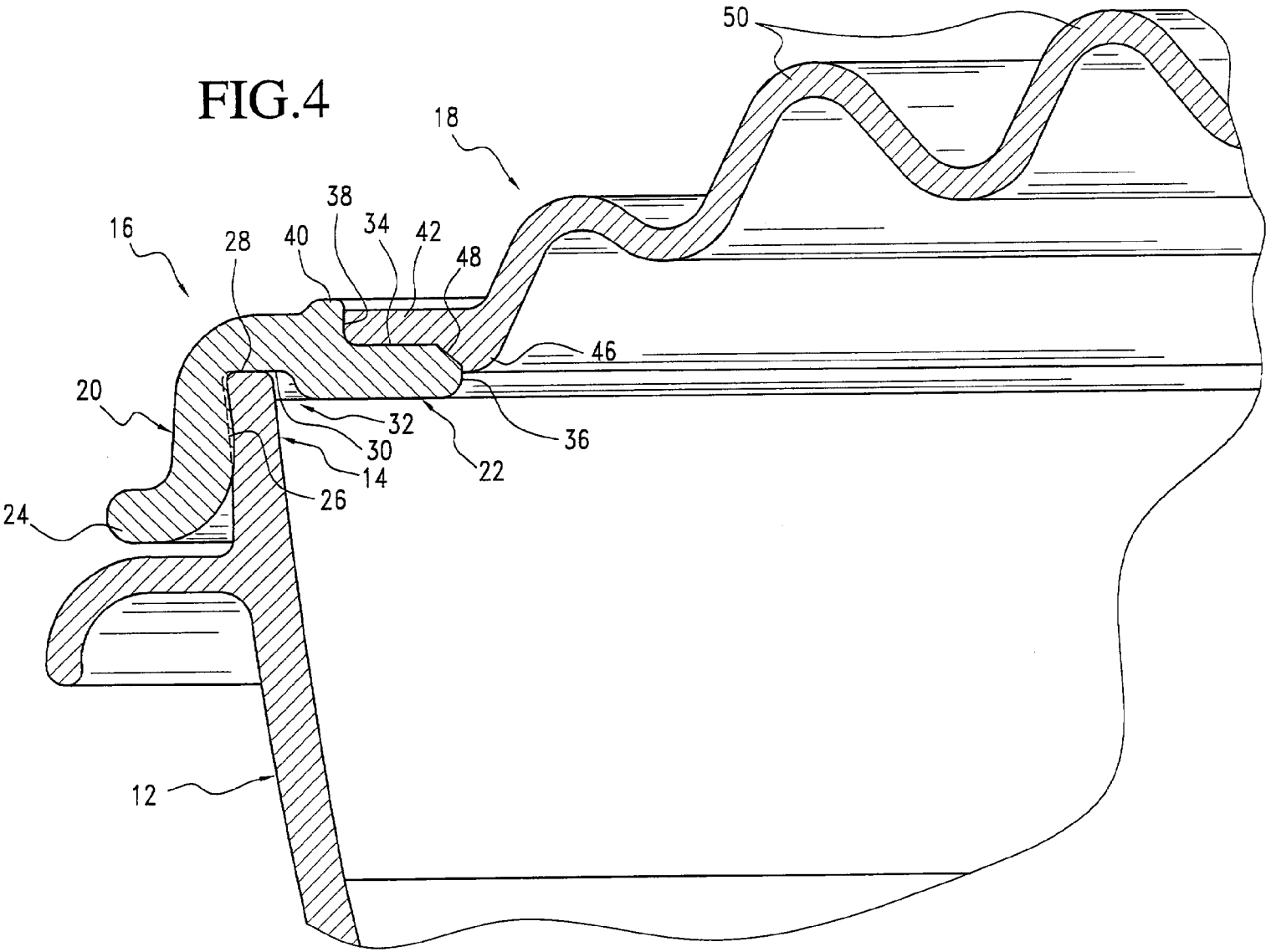
FIG. 4 is an enlarged detail of the area designated as FIG. 4 in FIG. 2.

Noting the cross-sectional detail of FIG. 4 in particular, the mounting ring 16 includes a vertical wall 20, an integral upper flange 22 extending inwardly from the wall, and an integral outer lower flange 24 outwardly turned from the lower end of the wall 20. The inner face 26 of the edge component wall 20 is slightly undercut toward the upper end thereof, generally conforming to the slightly outward canting of at least the outer face of the container rim 14. The mounting ring 16 is so configured and sized as to snap lock to the container rim 14 through a slight flexure of the ring 16 and/or a corresponding slight flexure in the container rim as with a conventional container and seal combination. So mounted, the inner face 26 of the wall 20 seals to and against the outer face of the container rim 14. When so positioned, and to provide for additional sealing, the upper edge 28 of the container rim 14 receives the undersurface 30 of the inner upper flange thereagainst. Removal of the seal can be facilitated by an integral gripping tab 25 formed as an extension of the lower ring flange 24.

The inner flange 22, inwardly of the ring wall 20, is upwardly offset to define a downwardly opening pocket 32 within which the rim engaging undersurface 30 of the inner flange is defined. An upwardly directed seat 34 extends to the inner end 36 of the inner flange 22. The seat 34, at the inner end thereof, defines an abutment 38, which extends upwardly into a protective bead 40. The total inward projection of the upper flange 22 peripherally about the ring 16, while sufficient as to position the inner peripheral edge 36 of the inner flange 22 in inwardly spaced relation to both the inner face 26 of the ring wall 20 and the container rim 14, extends, as illustrated radially inward for only a very minor portion of the diametric extent of the mounting ring 16.

The flexible central panel 18 is, at rest, configured in a manner whereby the peripheral edge portion 42 thereof is received on the ring seat 34, engaging the full radial width thereof and abutting against the seat formed abutment 38 slightly below the protective bead 40. This peripheral edge portion 42 will also include a depending annular bead or beaded portion 46 which engages against the inner edge 36 of the upper flange 22 upon a full seating within the flange seat 34. As illustrated in particular in FIG. 4, the flange inner edge 36 and bead 46 can have complementary flat beveled edges 48 to provide greater and more effective contacting surfaces. This is particularly significant at this point in that, as shall be explained subsequently, the flexible central panel will flex relative to and independently of the mounting ring in this area.

When positioned as above described, the overlying flange seat 34 and central panel peripheral edge portion, including the engaged beveled faces 48, are intimately bonded together by melt bonding or any other appropriate bonding process. Thus formed, the seal 10, notwithstanding the unique relationship of components, and the attendant advantages derived therefrom, will mount in the manner of a conventional container seal, snap locking into position upon manual pressure on the peripheral mounting ring.

The central panel 18 is of an appropriate molded flexible resilient material capable of lateral deflection, both upward, to accommodate an overfill condition in the container 12, and downward to accommodate an underfilled condition, relative to the mounting ring 16 and to a generally central plane defined by the inner peripheral edge 36 of the inner flange 22 of the mounting ring. This flexure takes place inward of the flange inner edge 36 relative to the mounting ring and is accomplished without any corresponding disruptive movement of the mounting ring. This is distinctly contrary to the substantially more rigid central panels of some of the prior art which, while in some instances are manually deflected, do so to specially cause a corresponding deflection in the sealing periphery of the seal to either mount or facilitate removal of the seals.

The flexible central panel, as the mounting ring is snapped into engagement with the container rim, will flex upward and accommodate itself to the height and shape of overfill. In an underfill situation, after the seal is mounted, downward manual pressure on the central panel will cause a forced or pressurized expelling of air, i.e. "burping", from the head space past the normally sealed sealing surfaces of the mounting ring and container rim. Upon release of the manual downward force on the central panel, the downwardly flexed central panel is retained in position in light of the partial vacuum or underpressure created by the expelling of air from the head space and the resealed mounting ring. Thus, all of the advantages of reduced head space, including content stabilization, increased shelf life, a partial vacuum environment, and the like, are obtained in a simple and effective manner.

As an alternate possible manner of mounting the seal to accommodate an underfill, the central panel can be downwardly depressed and manually held in this position as the ring is snap-locked to the container rim. After mounting, the central panel, in light of the elastic memory of the material, will tend to move outward, thus creating the desired partial vacuum or reduced pressure relative to the ambient atmospheric pressure. This in turn will maintain the central panel depressed.

Figure 2:
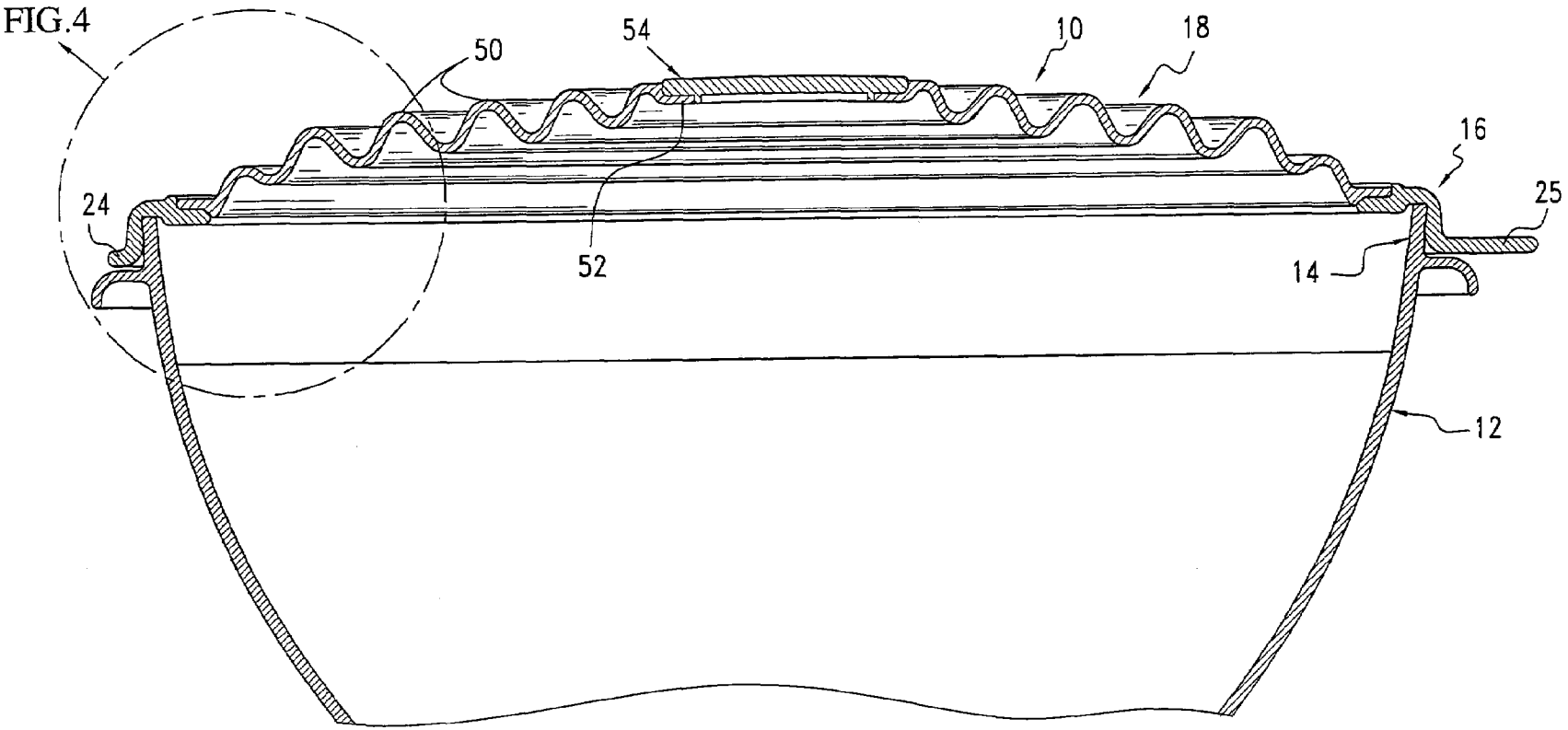
FIG. 2 is a cross-sectional detail taken substantially on a plane passing along line 2—2 in FIG. 1.
Figure 3:
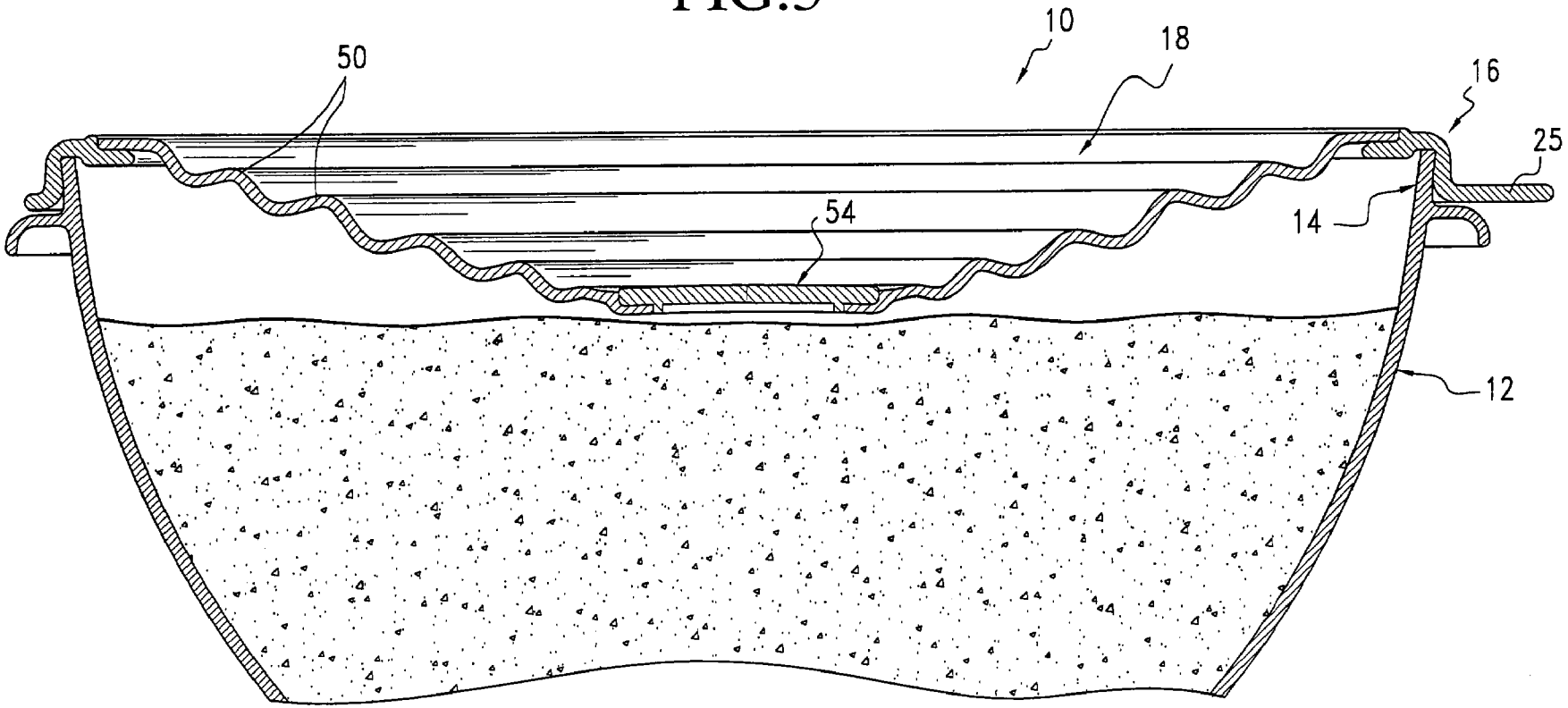
FIG. 3 is a cross-sectional detail with the central panel deformed laterally inward of the ring to reduce the container head space.

Referring to FIGS. 1 and 2 in particular, it is intended that the flexibility of the central panel 18, and the extent of movement or lateral deflection thereof be enhanced by the formation therein of a series of concentric ripples in the nature of corrugations or small undulations 50 of progressively greater diameters outward from the central area of the central panel 18. These ripples or undulations 50 will, in a recognized manner, flexibly and resiliently expand as the vertical position of the central panel varies in accord with pressure applied thereto either by overfilled contents of the container or manual pressure. It is contemplated that the vertical deflection of the central panel be approximately one-third the diameter of the seal.

In order to facilitate the application of equalized and evenly distributed manual pressure in an underfill situation, the central area 52 of the central panel 18, as noted in FIGS. 1–3 and 5, can be provided with a rigid disc, preferably in the form of a legend bearing medallion 54. The disk will be fixed to the central area in any appropriate manner as by melt bonding.

Figure 6:
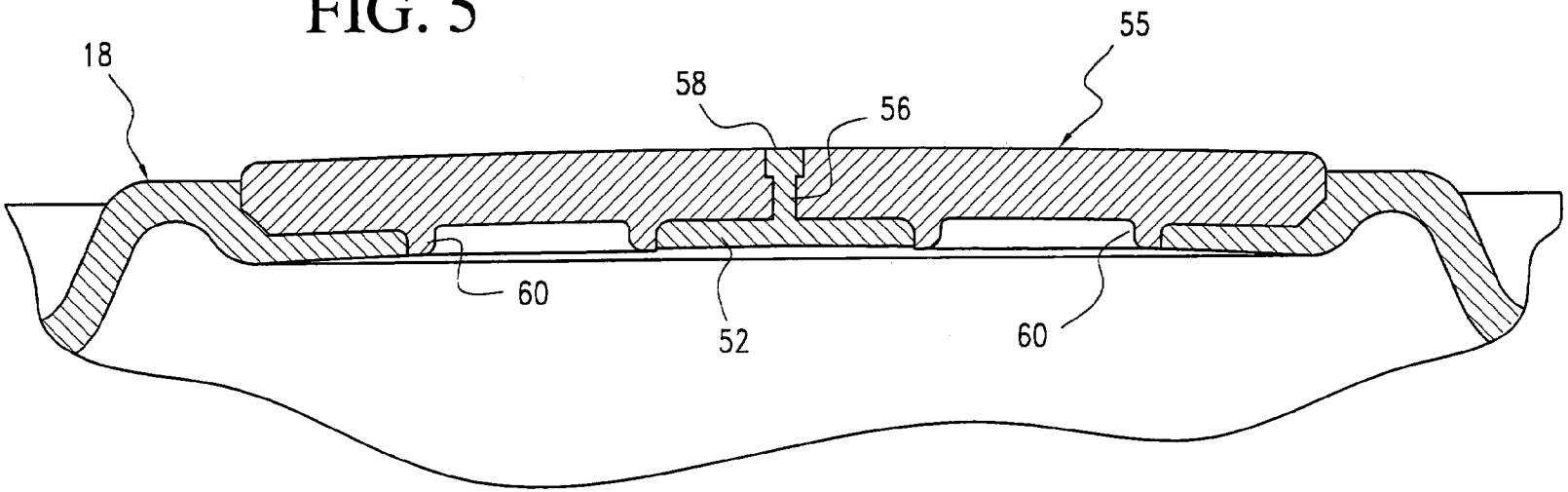
FIG. 6 is a cross-section similar to FIG. 5 illustrating an alternate form of medallion.
Figure 7:
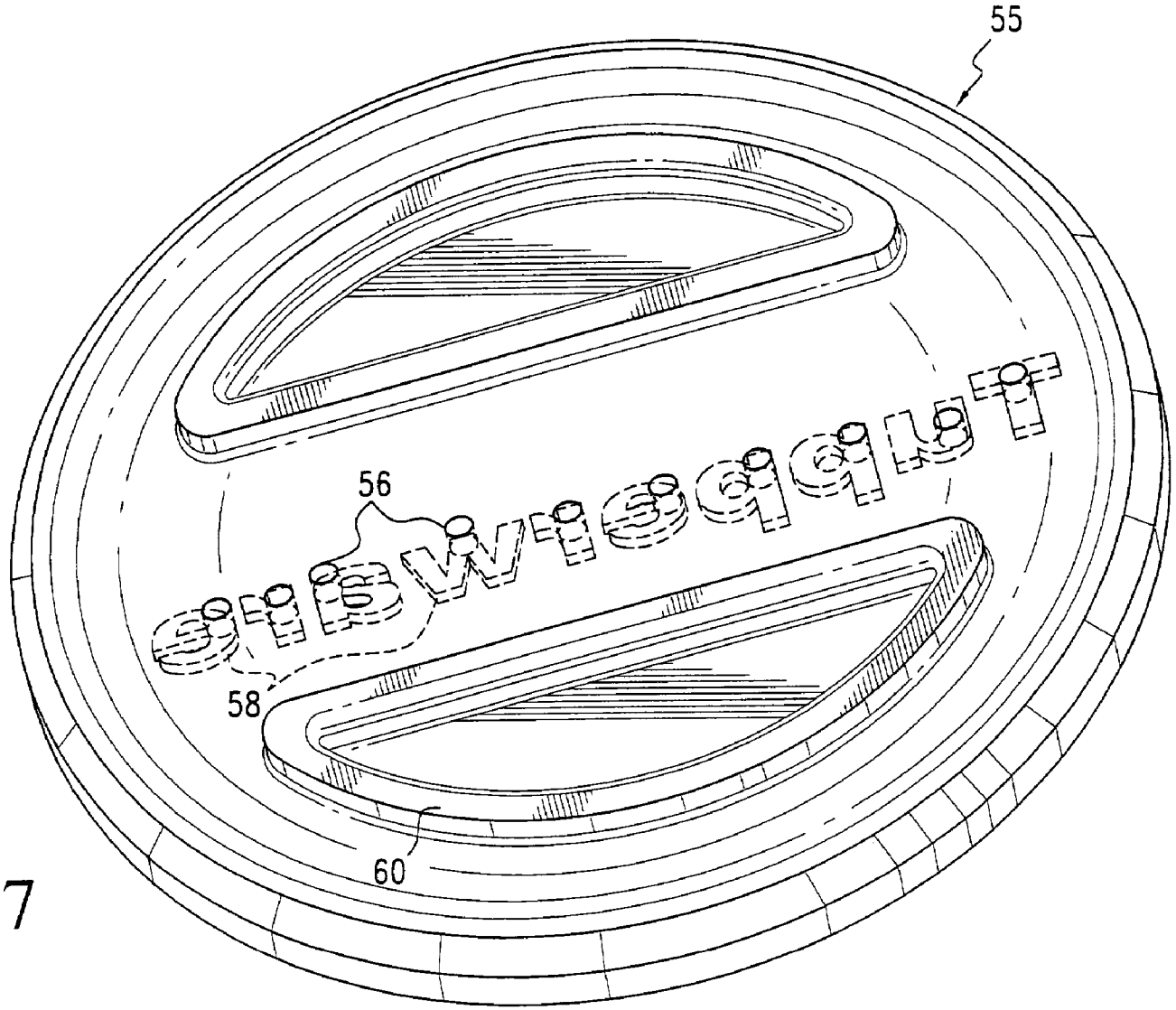
FIG. 7 is a bottom perspective view of the medallion prior to mounting.

As a variation, and noting FIGS. 6 and 7, the disk or medallion 55 may have the legend defined therein by having the panel material of the flat central area 52 flow upwardly through transverse openings 56 in the overlying medallion body and into letter forming recesses 58 in the upper surface of the medallion. In this manner, the medallion 55 is fixed, such as by melt bonding or the like, to the central panel and the material of the central panel 18 defines the legend as it appears on the upper surface of the medallion 54. If the legend is to consist of separate unconnected letters, it will be appreciated that a through hole, or runner, 56 will be provided for communication with each letter for the passage of the flowable material therethrough during the molding process.

Figure 5:
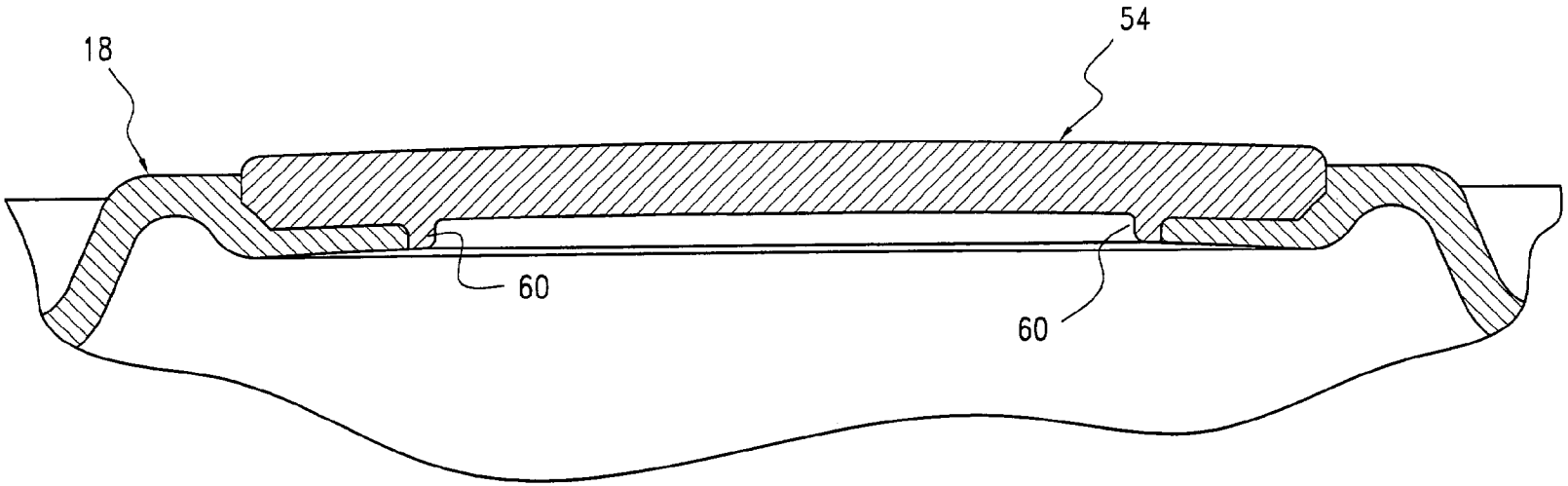
FIG. 5 is an enlarged cross-sectional detail through the central medallion taken substantially on a plane passing along line 5—5 in FIG. 1.

As illustrated in FIGS. 5, 6 and 7, the bottom surface of the medallion will preferably include depending continuous locking and stabilizing ribs 60 which enhance the bond between the medallion and the central area of the central panel.

Figure 8:
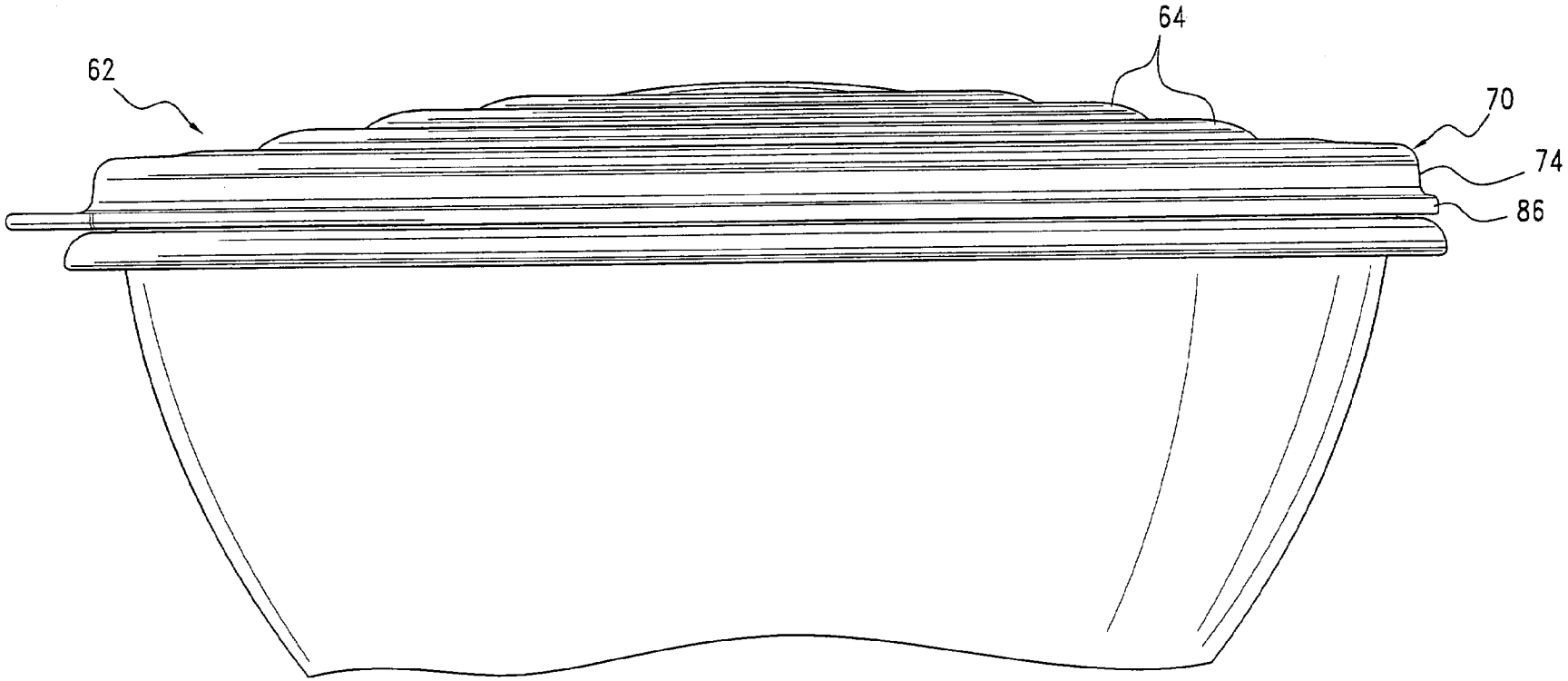
FIG. 8 is an elevational view of a modified form of seal mounted to a container rim.
Figure 9:
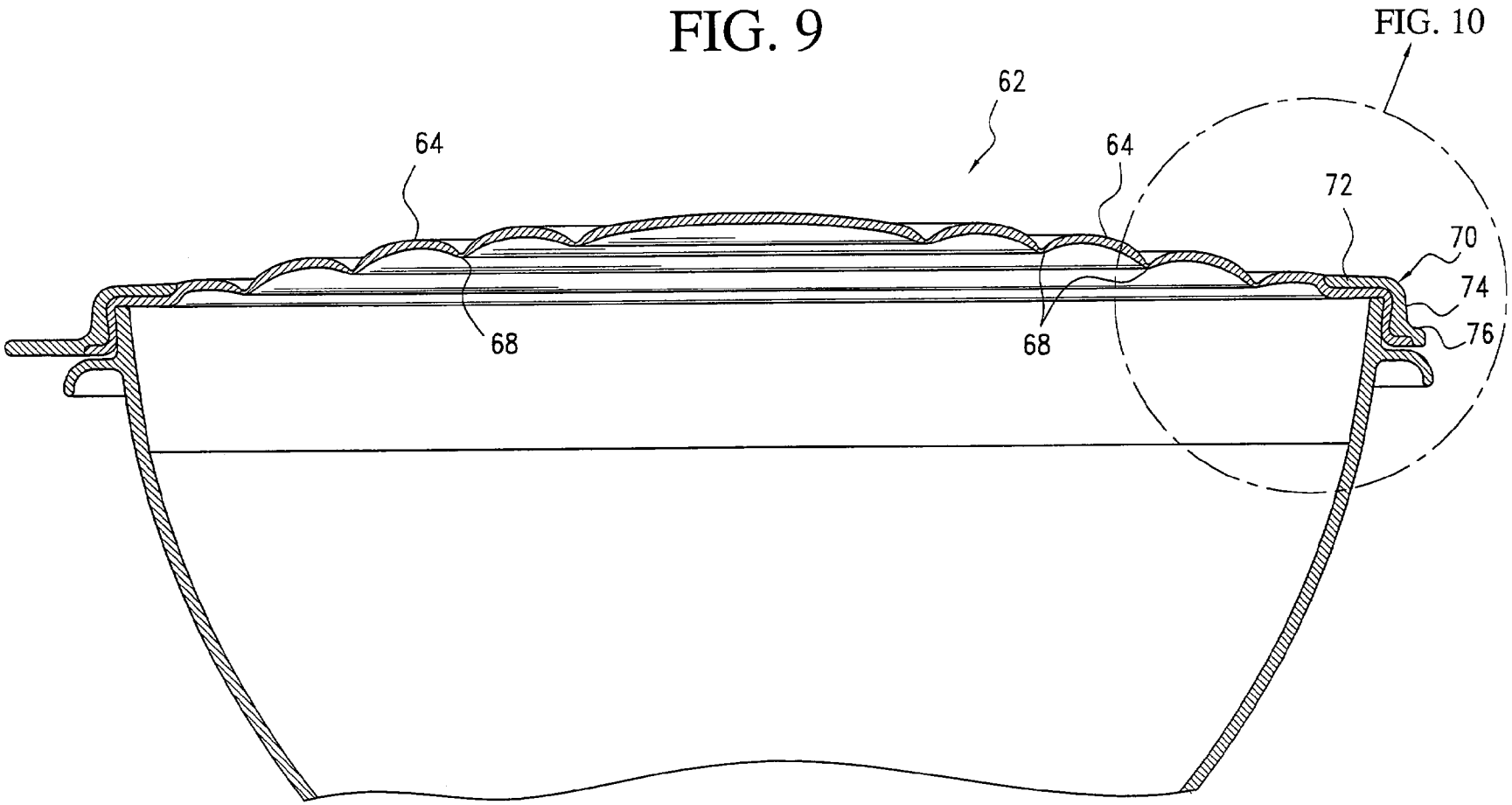
FIG. 9 is a transverse cross-section through the structure of FIG. 8.
Figure 10:
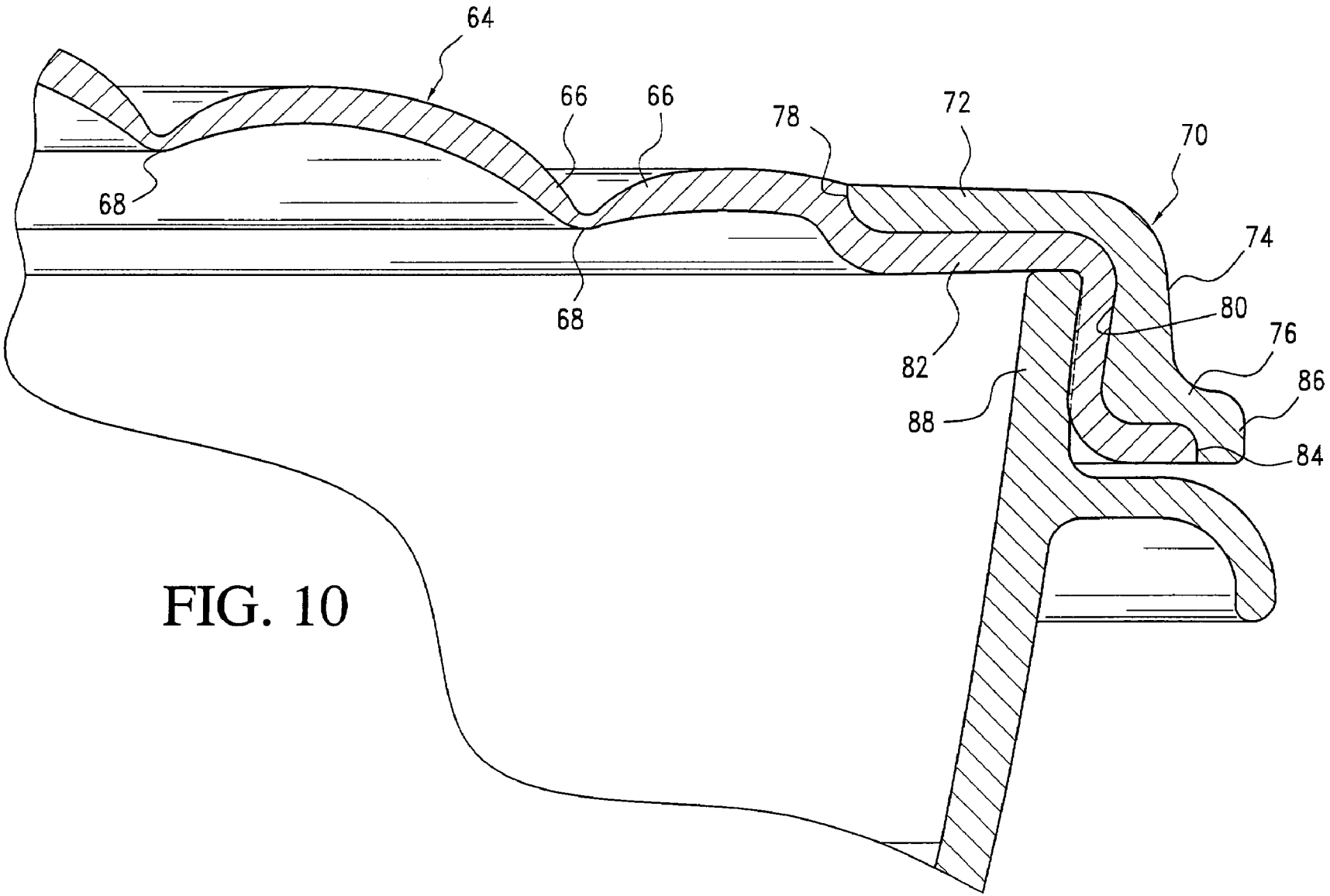
FIG. 10 is an enlarged cross-sectional detail illustrating the bonded area between the central panel and mounting ring, and designated as FIG. 10 in FIG. 9.

Referring now specifically to FIGS. 8, 9 and 10, a second embodiment of seal has been illustrated therein. In this embodiment, the corrugations or undulations 64 are both flatter and wider than the previously described undulations which were more in the nature of regular corrugations with equal and alternate peaks and valleys. Further, the undulations 64, rather than being of a constant cross section, are narrower at the opposed edges 66 thereof where they meet adjacent undulations and define relatively thinner valleys 68. So formed, the flexible central panel, while having a relatively low or flat profile, will allow for substantial flexure relative to the container and mounting ring 70. With specific regard to the mounting ring 70, it will be noted that the ring, similar to the ring 16, includes an upper inwardly directed flange 72, a generally upright or vertical wall 74 and a laterally outwardly directed lower flange portion 76. The inward extending upper flange 72 includes a planar undersurface from the inwardly positioned end 78 thereof to the slightly undercut inner face of the upright wall 74. The peripheral edge portion 82 of the central panel 62 is overlaid on the mounting ring 70 and intimately bonded thereto along the full extent of the undersurface of the inner flange 72, the inner wall surface 80 of the wall 74, and the undersurface of the lower outer flange 76 with the extreme end 84 of the peripheral edge portion abutting against a downturned lip 86 depending from the outer flange 76 to provide a protective finish for the edge 84. Similarly, the end 78 of the upper flange abuts against an upwardly turned portion of the central panel as the peripheral edge portion 82 thereof merges into a first one of the undulations 64. Formed in this manner, the resiliently flexible material of the peripheral edge portion 82 of the central panel, engageable between the bonded mounting ring 70 and the rim portion 88 of the container enhances the sealing of the seal to the container.

As with the first described embodiment, the flexing of the central panel occurs inwardly of the inner edge of the upper flange 72 relative to the mounting ring and independent of the mounting ring so as to not affect either the sealing or the positioning of the mounting ring. As desired, the central area of the central panel 62 can also be provided with a rigid or substantially rigid disc or medallion similar to the medallion 54 of the first embodiment.

As will be recognized from the foregoing, the invention is both particularly user friendly in that the seal mounts and is removable from a container in the manner of a conventional seal and at the same time provides for distinct advantages in accommodating both container overfill and underfill. In those situations wherein an underfilled container is to be accommodated, one need merely mount the seal in the conventional manner and then depress the flexible central panel, which action reduces the head space and creates a partial internal vacuum or underpressure with the attendant advantages of product stabilization and enhanced product preservation.

The foregoing is illustrative of the principles of the invention. While specific embodiments have been illustrated, other embodiments as encompassed within in the scope of the appended claims will occur to those skilled in the art and are deemed to fall within the scope of the invention.

The invention claimed is:

1. A seal removably mountable to the rim of a container, said seal comprising a substantially rigid peripheral mounting ring and a flexible central panel, said mounting ring being of a fixed predetermined shape-sustaining configuration surrounding said central panel, said flexible central panel at rest being generally in a plane defined by said ring and having a peripheral edge portion bonded to said ring, a non-bonded portion of said central panel being flexibly deformable laterally and in opposite directions independently of and relative to said ring to define variations in the effective height of the central panel both above and below said mounting ring relative to a single underlying container.

2. The seal of claim 1 wherein said central panel is elastically deformable.

3. The seal of claim 2 wherein said central panel is flexibly deformable independently of said mounting ring and with said mounting ring maintained in said predetermined configuration.

4. The seal of claim 3 wherein said mounting ring includes an upright wall adapted to surround and engage a container rim, a ring flange integral with and extending inward relative to said wall and adapted to overlie and extend inwardly relative to an underlying container rim, said flange defining an inner peripheral edge, said peripheral edge portion of said central panel peripherally overlapping and being bonded to said flange, said central panel being flexible relative to said flange inward of said flange inner peripheral edge.

5. The seal of claim 4 wherein said central panel, at said flange, includes an abutment engaged against and bonded to said flange inner peripheral edge.

6. The seal of claim 4 wherein said central panel includes spaced concentric undulations therein to enhance flexibility and the degree of flexible deformation.

7. The seal of claim 6 wherein said central panel includes a central area defining a position for the application of a downwardly deforming pressure to said central panel, and a rigid disc overlying and bonded to said central area for equalization of applied pressure to said central panel.

8. The seal of claim 6 wherein said undulations comprise corrugations with substantially equal height ridges and valleys.

9. The seal of claim 6 wherein said undulations comprise low profile ridges each with a cross-sectional thickness narrowing toward opposed edges thereof and defined valleys therebetween.

10. The seal of claim 9 wherein said valleys defined between said ridges are each of a cross-sectional thickness less than the cross-sectional thicknesses of the ridges to each side thereof.

11. The seal of claim 4 wherein said peripheral edge portion of said central panel underlies said flange and extends to and along said wall, bald peripheral edge portion being bonded to both said flange and said wall and adapted to lie between and provide enhanced sealing between said mounting ring and the rim of a container to which the ring is mounted.

12. The seal of claim 3 wherein said central panel includes a central area defining a position for the application of a downwardly deforming pressure to said central panel, and a rigid disc overlying and bonded to said central area for equalization of applied pressure to said central panel.

13. A seal adapted to mount to the rim of a container for varying the internal head space in the container, said seal comprising a flexible central panel and a substantially rigid peripheral mounting ring surrounding said central panel, said central panel having a peripheral edge portion peripherally bonded to said ring, said central panel being laterally flexible and positionable relative to said ring both above and below said ring and to the rim of a single underlying container to thereby vary the head space within the underlying container.

14. The seal of claim 13 wherein said substantially rigid mounting ring includes an upper flange projecting radially inward and defining a plane overlying a container rim receiving said seal with said flange extending inward of the container rim, said peripheral edge portion of said central panel overlapping and being bonded to said flange, said central panel, inward of said flange being generally in said plane and flexing independently of and without distortion of said flange and mounting ring.

15. The seal of claim 14 including a series of generally concentric undulations defined in said flexible central panel for enhancing the flexibility and range of movement of said central panel.

16. The seal of claim 15 wherein said central panel includes a central area defining a position for the application of a downwardly deforming pressure to said central panel, and a rigid disc overlying and bonded to said central area for equalization of applied pressure to said central panel.

17. The seal of claim 13 wherein said mounting ring includes means for sealing said seal peripherally to and about a container rim.

18. In combination with a substantially rigid open-mouth container having a peripheral rim defining said mouth, a seal, said seal including an outer peripheral substantially rigid mounting ring releasably sealable to said container rim, a flexible central panel bonded peripherally to said ring to overlie the mouth of the container, a non-bonded portion of said central panel being flexible relative to said container rim and independent of said substantially rigid mounting ring, said panel laterally flexing outward relative to said container rim to enlarge container head space and accommodate an overfilled condition in said container, said panel laterally flexing inward relative to said container rim to reduce container head space in an underfilled container, and said flexing outward and said flexing inward being relative to a single said open-mouth container.

19. The combination of seal and container of claim 18 wherein said central panel is flexibly resilient and, when flexed inward, creates a partial vacuum in said container with said central panel retained inwardly flexed by said partial vacuum to maintain a reduced head space.

20. The combination seal and container of claim 19 including a series of generally concentric undulations defined in said flexible central panel for enhancing the flexibility and range of movement of said central panel.

21. The seal of claim 1 wherein said substantially rigid peripheral mounting ring has an annular shape and configuration.

22. The seal of claim 1 wherein said wherein said substantially rigid peripheral mounting ring has a rectangular shape and configuration.

23. The seal of claim 1 wherein said wherein said substantially rigid peripheral mounting ring has a square shape and configuration.

24. The seal of claim 1 wherein said wherein said substantially rigid peripheral mounting ring has an oval shape and configuration.

25. The combination of seal and container of claim 18 wherein said substantially rigid peripheral mounting ring has an annular shape and configuration.

26. The combination of seal and container of claim 18 wherein said substantially rigid peripheral mounting ring has a rectangular shape and configuration.

27. The combination of seal and container of claim 18 wherein said substantially rigid peripheral mounting ring has a square shape and configuration.

28. The combination of seal and container of claim 18 wherein said substantially rigid peripheral mounting ring has an oval shape and configuration.

* * * * *